US011297936B2

(12) United States Patent
Choi

(10) Patent No.: US 11,297,936 B2
(45) Date of Patent: Apr. 12, 2022

(54) COLLAPSIBLE SUPPORTING FRAME AND FURNITURE HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 88 days.

(21) Appl. No.: 16/601,308

(22) Filed: Oct. 14, 2019

(65) Prior Publication Data

US 2020/0146438 A1 May 14, 2020

(51) Int. Cl.

| | |
|---|---|
| ***A47B 3/00*** | (2006.01) |
| ***A47B 3/06*** | (2006.01) |
| ***A47C 4/02*** | (2006.01) |
| ***A47C 4/04*** | (2006.01) |
| ***A47B 13/00*** | (2006.01) |

(52) U.S. Cl.

CPC ..... *A47B 3/002* (2013.01); *A47B 3/06* (2013.01); *A47B 13/003* (2013.01); *A47C 4/02* (2013.01); *A47C 4/045* (2013.01)

(58) Field of Classification Search

CPC combination set(s) only.
See application file for complete search history.

(56) References Cited

U.S. PATENT DOCUMENTS

| | | | | |
|---|---|---|---|---|
| 273,332 | A | 3/1883 | Woodin | |
| 277,541 | A | 5/1883 | Bowers | |
| 372,913 | A | 11/1887 | Hopkins | |
| 557,997 | A | 4/1896 | Nessel | |
| 687,238 | A | 11/1901 | Johnson | |
| 705,384 | A | 7/1902 | Cooper | |
| 736,569 | A | 8/1903 | Webb | |
| 746,211 | A | 12/1903 | Webb | |
| 797,011 | A | 8/1905 | Mosier | |
| 984,823 | A | 2/1911 | Linden | |
| 1,072,550 | A * | 9/1913 | Wilson | A47B 3/0912 108/159.12 |
| 1,694,420 | A | 12/1928 | Joselowitz | |
| 1,760,955 | A | 6/1930 | Moss | |
| 1,806,358 | A | 5/1931 | Manly | |
| 1,833,692 | A | 11/1931 | Silvio | |
| 2,057,334 | A | 10/1936 | Hannum | |
| 2,492,070 | A | 12/1949 | Stone et al. | |

(Continued)

FOREIGN PATENT DOCUMENTS

| | | | |
|---|---|---|---|
| DE | 102018130110 | A1 | 5/2020 |
| EP | 2182151 | A2 | 5/2010 |

*Primary Examiner* — Monica E Millner
(74) *Attorney, Agent, or Firm* — Morgan, Lewis & Bockius LLP

(57) ABSTRACT

Disclosed are a collapsible supporting frame and furniture having a collapsible supporting frame. A frame includes first and second supporting units, and first and second bar units disposed between the first and second supporting units. Each of the first and second supporting units includes a first leg, a second leg, and one or more lateral connecting bars disposed between and fixedly connected with the first and second legs. Each of the first and second bar units includes first and second bars rotatably connected with each other at their proximal ends. A distal end of the first bar is rotatably connected with the first or second leg of the first supporting unit. A distal end of the second bar is rotatably connected with the first or second leg of the second supporting unit.

21 Claims, 8 Drawing Sheets

(56) References Cited

U.S. PATENT DOCUMENTS 2,584,491 A 2/1952 Nelson
2,602,012 A 7/1952 Doty
2,680,252 A 6/1954 Hatton
2,772,424 A 12/1956 Roche
2,782,075 A * 2/1957 Fagan ..... E04G 1/34 182/152
2,823,392 A 2/1958 Howard
2,905,513 A * 9/1959 Kane ..... A47B 3/00 108/128
2,962,085 A * 11/1960 Frank ..... A47C 4/283 297/36
2,983,931 A 5/1961 Nelson
3,185,499 A 5/1965 Reese
3,245,363 A * 4/1966 Kanitz ..... A47B 3/087 108/168
3,296,983 A * 1/1967 Brush ..... A47B 25/00 108/90
3,504,877 A 4/1970 Lyon, Sr.
3,605,142 A 9/1971 Weinhart
3,613,132 A 10/1971 Weinhart
3,657,748 A 4/1972 Weinhart
3,984,884 A 10/1976 Spitz
4,341,164 A * 7/1982 Johnson ..... A47B 3/10 108/115
4,391,008 A 7/1983 Yamaoka et al.
4,745,644 A 5/1988 Pottschmidt
4,788,727 A 12/1988 Liu
4,974,526 A * 12/1990 Wiygul, Jr. ..... A47B 3/002 108/157.1
5,469,589 A 11/1995 Steed
5,562,050 A * 10/1996 Colquhoun ..... A47B 3/002 108/115
5,884,566 A * 3/1999 Chen ..... A47B 13/08 108/67
5,943,968 A * 8/1999 Dobson ..... A47B 87/002 108/124
6,449,786 B1 9/2002 Voit
6,485,219 B1 * 11/2002 Beyer ..... A47B 87/008 403/338
7,003,822 B1 2/2006 Sheehy
7,376,986 B2 5/2008 Smith
7,690,316 B2 * 4/2010 Yoo ..... E04G 1/34 108/115
7,739,760 B2 6/2010 Smith
7,784,122 B2 8/2010 Oh
RE41,763 E * 9/2010 Ng ..... A47B 43/00 211/149
7,845,030 B1 12/2010 Pollard
8,006,328 B2 8/2011 Polevoy
8,006,329 B2 8/2011 Oh
8,042,205 B2 10/2011 Schulz, Jr.
8,176,581 B2 5/2012 Schulz, Jr.
8,678,490 B2 * 3/2014 Chen ..... A47C 4/283 297/36
8,822,885 B2 * 9/2014 Daneshvar ..... A47B 21/03 219/218
8,832,876 B1 9/2014 Oh
8,935,819 B1 1/2015 Hartley
8,978,176 B1 3/2015 Oh
8,990,979 B1 3/2015 Craver
9,021,964 B2 * 5/2015 Peng ..... A47B 3/002 108/116
9,332,833 B2 * 5/2016 Kim ..... A61G 13/105
9,596,943 B1 3/2017 Hartley
9,924,804 B2 3/2018 Hartley
10,321,767 B2 6/2019 Jin
10,687,630 B1 6/2020 Hartley
10,702,070 B2 7/2020 Oh
10,959,529 B2 3/2021 Choi
10,959,530 B2 3/2021 Choi
10,966,537 B1 4/2021 Denney
2006/0107456 A1 5/2006 Joseph
2008/0109958 A1 5/2008 Wang
2009/0025143 A1 1/2009 Oh
2010/0170190 A1 7/2010 Schulz, Jr.
2010/0171342 A1 * 7/2010 Chen ..... A47C 4/283 297/45
2010/0235989 A1 9/2010 Jin
2010/0275372 A1 11/2010 Oh
2010/0299831 A1 12/2010 Lee
2011/0258777 A1 10/2011 Schulz, Jr.
2012/0204770 A1 * 8/2012 Grace ..... A47B 9/20 108/116
2012/0304380 A1 12/2012 Jin
2013/0000038 A1 1/2013 Schulz, Jr.
2013/0025051 A1 1/2013 Syrowitz
2014/0208506 A1 7/2014 Bartelsmeyer
2016/0143446 A1 5/2016 Hartley
2016/0255963 A1 9/2016 Jones
2016/0296004 A1 * 10/2016 Peng ..... A47B 3/002
2018/0042391 A1 2/2018 Oh
2018/0055235 A1 3/2018 Choi
2018/0116412 A1 5/2018 Jin
2018/0140103 A1 5/2018 Thompson
2019/0387888 A1 12/2019 Choi
2019/0387889 A1 12/2019 Choi
2019/0387890 A1 12/2019 Choi
2019/0387891 A1 12/2019 Choi
2019/0387892 A1 12/2019 Choi
2019/0387893 A1 12/2019 Choi
2020/0022501 A1 1/2020 Choi
2020/0022502 A1 1/2020 Choi
2020/0022503 A1 1/2020 Choi
2020/0146438 A1 5/2020 Choi
2020/0378426 A1 12/2020 Choi

* cited by examiner

COLLAPSIBLE SUPPORTING FRAME AND FURNITURE HAVING SAME

CROSS-REFERENCE TO RELATED APPLICATIONS

The present application claims priority to Chinese Utility Model Application CN 201821844027.9 filed Nov. 11, 2018. The disclosure of the application is incorporated herein for all purposes by reference in its entirety.

FIELD OF THE INVENTION

The present invention generally relates to supporting frames, and more particularly, to collapsible supporting frames and furniture having collapsible supporting frames.

BACKGROUND

Tables and chairs are common household furniture items. However, many existing tables and chairs are not user-friendly. For instance, supporting frames of some existing tables and chairs are integrally made as one unit. They cannot be disassembled or folded. As such, they are extremely inconvenient to carry or store. Supporting frames of some other existing tables and chairs can be disassembled but they usually are complex, and thus inconvenient to disassemble/assemble and use.

Given the current state of the art, there remains a need for collapsible supporting frames and furniture that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides collapsible supporting frames and furniture such as tables and chairs with collapsible supporting frames.

In various exemplary embodiments, the present invention provides a collapsible supporting frame including a first supporting unit, a second supporting unit, a first bar unit and a second bar unit. The first supporting unit is disposed at a first side of the collapsible supporting frame. The second supporting unit is disposed at a second side of the collapsible supporting frame. The first bar unit has a first end rotatably connected with a first end of the first supporting unit and a second end rotatably connected with a first end of the second supporting unit. The second bar unit has a first end rotatably connected with a second end of the first supporting unit and a second end rotatably connected with a second end of the second supporting unit. Each of the first and second bar units includes a first bar and a second bar. Each of the first and second bars includes an upper slot and a lower slot at a proximal end thereof. The upper slots of the first and second bars are symmetrically disposed with respect to each other, and the lower slots of the first and second bars are symmetrically disposed with respect to each other. A first insert has a first end disposed in the upper slot of the first bar and rotatably connected with the first bar, and a second end disposed in the upper slot of the second bar and rotatably connected with the second bar. A second insert has a first end disposed in the lower slot of the first bar and rotatably connected with the first bar, and a second end disposed in the lower slot of the second bar and rotatably connected with the second bar.

In some exemplary embodiments, each of the first and second bar units further includes a first shaft substantially perpendicular to the first bar and a second shaft substantially perpendicular to the second bar. The first or second insert includes a first through-hole and a second through-hole. The first or second insert is rotatably connected with the first bar by the first shaft through the first through-hole, and rotatably connected with the second bar by the second shaft through the second through-hole.

In an exemplary embodiment, middle portions of the first and second inserts are connected by a limiting member.

In some exemplary embodiments, the first bar includes a first receptacle and the second bar includes a second receptacle. The first or second receptacle is configured to removably receive an end of a lateral supporting bar.

In some exemplary embodiments, each of the first and second supporting units includes a first leg at the first end thereof and a second leg at the second end thereof. The first bar unit is disposed between the first legs of the first and second supporting units. The second bar unit is disposed between the second legs of the first and second supporting units. Each of the first and second legs of the first and second supporting units includes a first bracket at an interior side thereof. Each of the first and second ends of the first and second bar units includes a second bracket at an interior side thereof. Each first bracket is rotatably coupled with a corresponding second bracket.

In some exemplary embodiments, each of the first and second brackets includes an upper portion, a middle portion and a lower portion. The middle portion of the first bracket is fixedly connected with the first or second end of the first or second bar unit. The middle portion of the second bracket is fixedly connected with the first or second leg of the first or second supporting unit. The upper portion of the second bracket is disposed below and rotatably connected with the upper portion of the first bracket. The lower portion of the second bracket is disposed above and rotatably connected with the lower portion of the first bracket.

In an exemplary embodiment, the middle portion of the first or second bracket is formed with a slot.

In some exemplary embodiments, a panel is disposed on the first and second supporting units, and connected with the first and second supporting units by a plurality of pins disposed spatially along a periphery of the panel and coupled with at least one lateral pin hole formed on top of at least one leg in the first and second legs of the first and second supporting units and at least one longitudinal pin hole formed on top of at least one leg in the first and second legs of the first and second supporting units.

In some exemplary embodiments, the first leg of each of the first and second supporting units includes a first upper portion above the first bar unit. The collapsible supporting frame further includes a plurality of longitudinal connecting bars disposed between the first upper portions of the first legs of the first and second supporting units and removably connected with the first upper portions of the first legs by slots disposed at the first upper extensions and corresponding couplers at ends of the longitudinal connecting bars.

In an exemplary embodiment, each slot is a "T" shaped slot open at a top and closed at a bottom.

In various exemplary embodiments, the present invention provides a collapsible supporting frame including a first supporting unit, a second supporting unit, a first bar unit and a second bar unit. The first and second supporting units are disposed substantially symmetrically with each other. Each of the first and second supporting units includes a first leg, a second leg, and one or more lateral connecting bars disposed between and fixedly connected with the first and second legs. The first and second bar units are disposed between the first and second supporting units. Each of the first and second bar units includes a first bar and a second bar. The first and second bars are rotatably connected with each other at proximal ends thereof. A distal end of the first bar is rotatably connected with the first or second leg of the first supporting unit. A distal end of the second bar is rotatably connected with the first or second leg of the second supporting unit. Rotational movement of the first and second bars pulls the first and second supporting units together or pushes the first and second supporting units away from each other.

In some exemplary embodiments, each of the first and second bars includes an upper slot and a lower slot at the proximal end thereof, wherein the upper slots of the first and second bars are symmetrically disposed with respect to each other, and the lower slots of the first and second bars are symmetrically disposed with respect to each other. A first insert has a first end disposed in the upper slot of the first bar and rotatably connected with the first bar, and a second end disposed in the upper slot of the second bar and rotatably connected with the second bar. A second insert has a first end disposed in the lower slot of the first bar and rotatably connected with the first bar, and a second end disposed in the lower slot of the second bar and rotatably connected with the second bar.

In an exemplary embodiment, middle portions of the first and second inserts are connected by a limiting member, wherein the limiting member restricts rotation of the first and second bars within certain positions.

In some exemplary embodiments, the first bar includes a first receptacle and the second bar includes a second receptacle, wherein the first or second receptacle is configured to removably receive an end of supporting bar.

In some exemplary embodiments, each of the first and second legs of the first and second supporting units includes a first bracket at an interior side thereof. Each dismal end of the first and second bars of the first and second bar units includes a second bracket at an interior side thereof. Each of the first and second brackets includes an upper portion, a middle portion and a lower portion. The middle portion of the first bracket is fixedly connected with the first or second leg of the first or second supporting unit. The middle portion of the second bracket is fixedly connected with the first or second end of the first or second bar unit. The upper portion of the second bracket is rotatably connected with the upper portion of the first bracket. The lower portion of the second bracket is rotatably connected with the lower portion of the first bracket.

In an exemplary embodiment, of each of the first and second brackets, the upper and lower portions are substantially perpendicular to the middle portion, wherein the upper and lower portions of one of the first and second brackets are disposed between the upper and lower portions of the other of the first and second brackets.

In various exemplary embodiments, the present invention provides a table including a collapsible supporting frame disclosed herein and a panel coupled with the collapsible supporting frame.

In some exemplary embodiments, of each of the first and second supporting units, the first leg has a length substantially the same as the second leg. At least one lateral pin hole is formed on top of at least one leg in the first and second legs of the first and second supporting units. At least one longitudinal pin hole is formed on top of at least one leg in the first and second legs of the first and second supporting units. The panel includes a plurality of pins disposed spatially along a periphery of the panel. The panel is disposed on the first and second supporting units, and connected with the first and second supporting units by two or more pins in the plurality of pins that are coupled with the at least one lateral pin hole and the at least one longitudinal pin hole.

In various exemplary embodiments, the present invention provides a chair including a collapsible supporting frame disclosed herein, wherein the first leg of each of the first and second supporting units includes a first upper portion above the first bar unit. A plurality of longitudinal connecting bars is disposed between the first upper portions of the first legs of the first and second supporting units and removably connected with the first upper portions of the first legs. The plurality of longitudinal connecting bars collectively serves as a backrest.

In some exemplary embodiments, the second leg of each of the first and second supporting units includes a second upper portion above the second bar unit, wherein the second upper portion is shorter than the first upper portion. Each of the first and second supporting units further includes an armrest, wherein the armrest has a first end connected with the first upper portion of the first leg, and a second end disposed on top of the second upper portion of the second leg and connected with the second upper portion of the second leg.

In some exemplary embodiments, the first bar includes a first receptacle and the second bar includes a second receptacle, wherein the first or second receptacle is configured to removably receive an end of lateral supporting bar. Of each of the first and second supporting units, a lateral connecting bar in the one or more lateral connecting bars includes a plurality of third receptacles. Each third receptacle is configured to removably receive an end of a longitudinal supporting bar that is disposed above or below the lateral supporting bars. The lateral and longitudinal supporting bars are configured to support a seat.

The collapsible supporting frames and furniture of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

Figure 1:
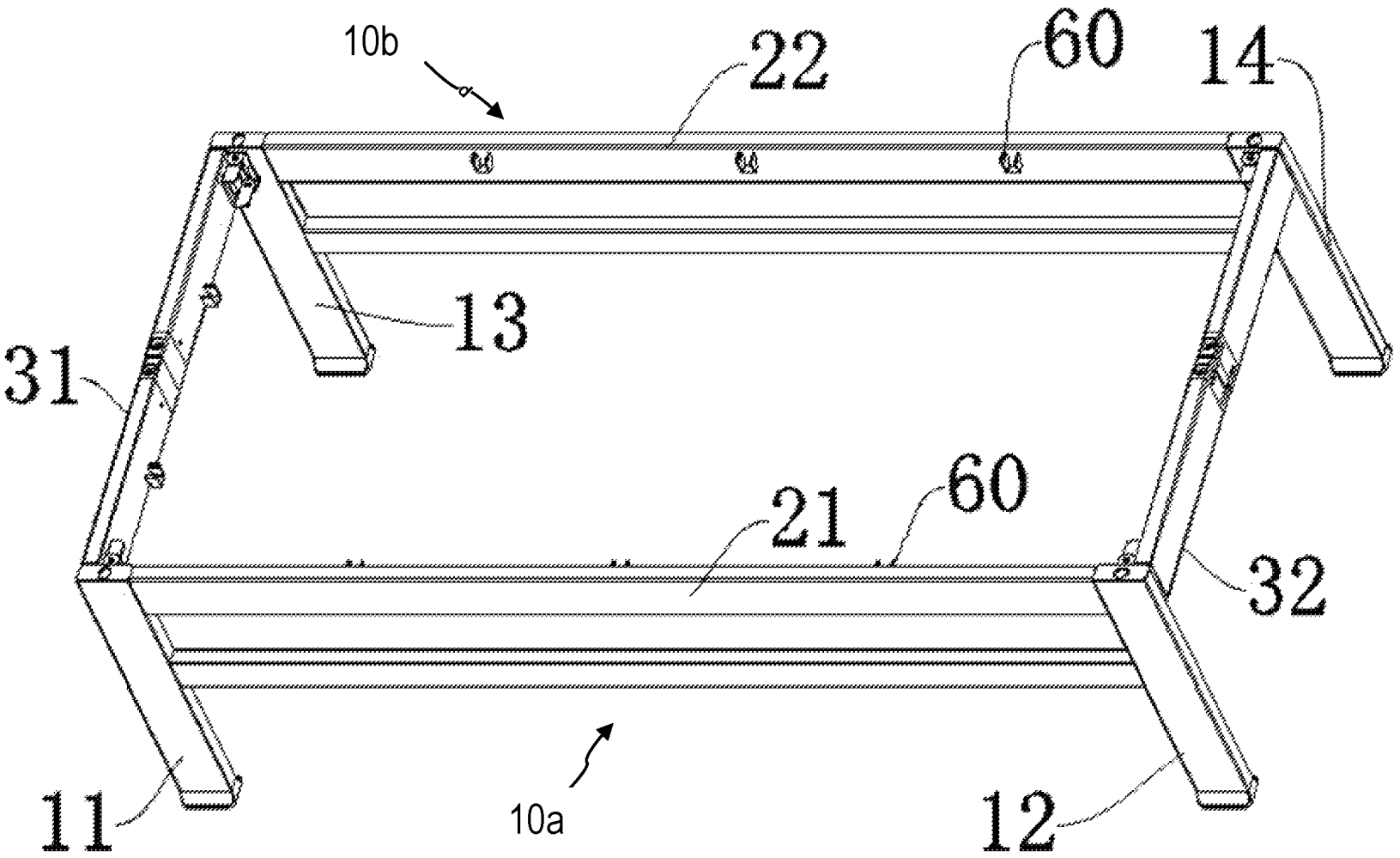
FIG. 1 is a perspective view illustrating an exemplary supporting frame in an expanded state in accordance with exemplary embodiments of the present invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of collapsible supporting frames, and tables and chairs having one or more such collapsible supporting frames. The collapsible supporting frames, tables and chairs of the present invention can be of various sizes. For instance, a collapsible frame of the present invention can be configured for a coffee table, a dining table, or the like, and can be of a square or rectangular shape. A collapsible supporting frame of the present invention can also be configured for an armchair, a lover seat, or the like. They can be made of various materials including but not limited to metals (e.g., iron, steel, aluminum), plastics and woods.

In general, a collapsible supporting frame of the present invention includes first and second supporting units disposed substantially symmetrically with respect to each other. Each of the first and second supporting units includes a first leg, a second leg, and one or more lateral connecting bars disposed between and fixedly connecting the first and second legs. The collapsible supporting frame also includes first and second bar units disposed between the first and second supporting units and rotatably connected with the first and second supporting units. In various exemplary embodiments, each of the first and second bar units includes a plurality of bars rotatably connected with each other such that rotational movement of the plurality of bars pulls the first and second supporting units together in contraction or pushes the first and second supporting units away from each other in expansion.

Figure 2:
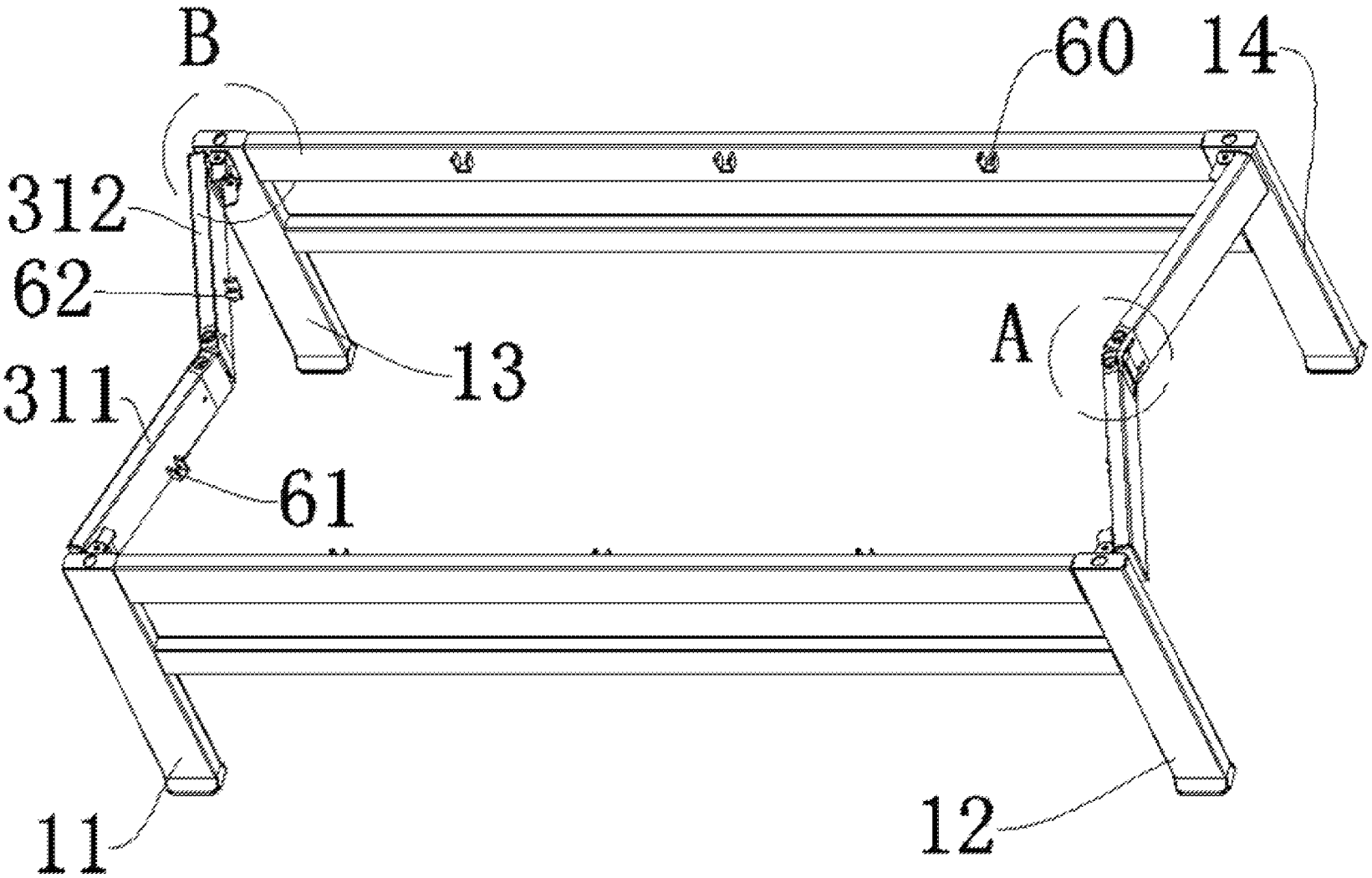
FIG. 2 is a perspective view illustrating an exemplary supporting frame in an intermediate state in accordance with exemplary embodiments of the present invention.

By way of example, FIGS. 1 and 2 illustrate an exemplary supporting frame including a first supporting unit such as first supporting unit 10*a* and a second supporting unit such as second supporting unit 10*b*. The first supporting unit is disposed at a first side of the supporting frame and the second supporting unit is disposed at a second side of the supporting frame. The first and second supporting units are substantially symmetrical with respect to each other.

In various exemplary embodiments, first supporting unit 10*a* includes a first leg such as first leg 11, a second leg such as second leg 12, and one or more lateral connecting bars such as lateral connecting bar 21. Similarly, second supporting unit 10*b* includes a first leg such as first leg 13, a second leg such as second leg 14, and one or more lateral connecting bars such as lateral connecting bar 22. Of each of the first and second supporting units, the one or more lateral connecting bars are disposed between and fixedly connected with the first and second legs.

A supporting frame of the present invention also includes a first bar unit such as first bar unit 31 and a second bar unit such as bar unit 32. The first and second bar units are disposed between the first and second supporting units and rotatably connected with the first and second supporting units. In various exemplary embodiments, each of the first and second bar units includes a plurality of bars rotatably connected with each other at their adjacent (or proximal) ends. By way of example, FIGS. 1 and 2 illustrate each of the first and second bar units including a first bar such as first bar 311 and a second bar such as second bar 312 rotatably connected with each other at their proximal ends. The distal end of first bar 311 is rotatably connected with first leg 11 or second leg 12 of the first supporting unit. The distal end of second bar 312 is rotatably connected with first leg 13 or second leg 14 of the second supporting unit.

As such, rotational movement of the first and second bars pulls the first and second supporting units together or pushes the first and second supporting units away from each other. For instance, during contraction, the first and second bars retreat into an interior space defined by the collapsible supporting frame when it is fully expanded. This allows the supporting frame to contract from an expanded state as illustrated in FIG. 1 to an intermediate state as illustrated in FIG. 2. Further contraction leads to a contracted state where first bar 311 and second bar 312 become substantially parallel to each other. This significantly reduces the size of the supporting frame in the contracted state. Moreover, this contraction process is reversible. For instance, it allows the supporting frame to expand from the contracted state, through the intermediate state as illustrated in FIG. 2, to the expanded state as illustrated in FIG. 1. Further, the contraction and expansion of the supporting frame are performed while the supporting units and the first and second bar units are connected with each other. There is no need to disconnect or disassemble these parts.

Figure 3:
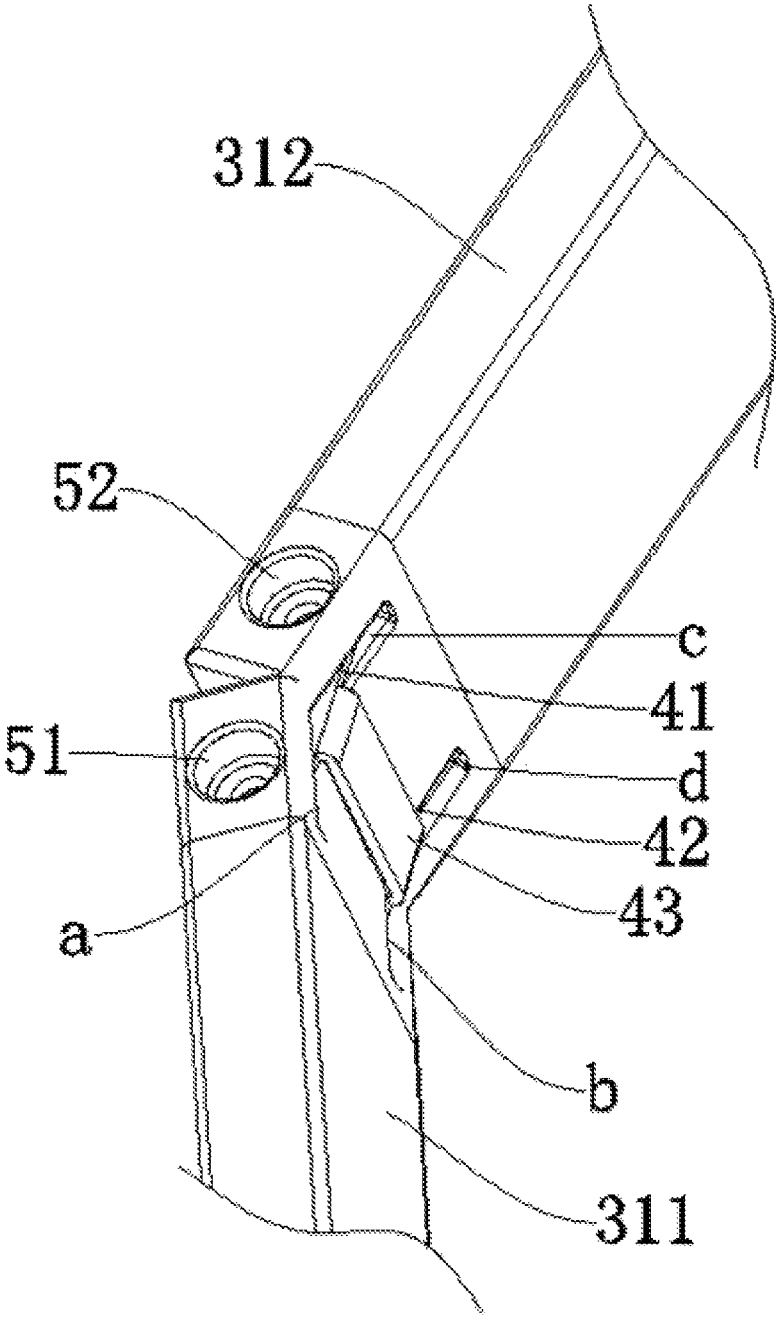
FIG. 3 is an enlarged view taken along circle A of FIG. 2.

Referring to FIG. 3, there is depicted an exemplary connector for connecting the proximal ends of the first and second bars of second bar unit 32. The connector includes one or more inserts disposed on one or more slots formed in the first and second bars. It should be noted that the proximal ends of the first and second bars of first bar unit 31 can be connected differently or in substantially the same way as illustrated in FIG. 3.

In some exemplary embodiments, first bar 311 includes an upper slot such as upper slot "a" and a lower slot such as lower slot "b" disposed below upper slot "a". Second bar 312 includes an upper slot such as upper slot "c" and a lower slot such as lower slot "d" disposed below upper slot "c". In an exemplary embodiment, upper slot "a" and upper slot "c" are substantially symmetric with respect to each other. Similarly, lower slot "b" and lower slot "d" are substantially symmetric with respect to each other.

A first insert such as first insert 41 is disposed in the upper slots of the first and second bars, and a second insert such as second insert 42 is disposed in the lower slots of the first and second bars. In some exemplary embodiments, first insert 41 has a first end disposed in the upper slot of the first bar and rotatably connected with the first bar, and a second end disposed in the upper slot of the second bar and rotatably connected with the second bar. Similarly, second insert 42 has a first end disposed in the lower slot of the first bar and rotatably connected with the first bar, and a second end disposed in the lower slot of the second bar and rotatably connected with the second bar.

In an exemplary embodiment, the first bar is formed with an opening, and the first end of each of the first and second inserts is formed with a through hole. The first bar is rotatably connected with the first ends of the first and second inserts by a first fastener such as first fastener 51 (e.g., bolt, latch, shaft) through the opening formed at the first bar and through-holes formed at the first ends of the first and second inserts. Similarly, the second bar is formed with an opening, and the second end of each of the first and second inserts is formed with a through hole. The second bar is rotatably connected with the second ends of the first and second inserts by a second fastener such as second fastener 52 (e.g., bolt, latch, shaft) through the opening formed at the second bar and through-holes formed at the second ends of the first and second inserts.

In some exemplary embodiments, middle portions of the first and second inserts are connected by a limiting member such as limiting member 43. The limiting member restricts rotation of the first and second bars within certain positions, e.g., between a contracted position where the first and second bars are substantially parallel to each other and an expanded position where the first and second bars are substantially aligned with each other.

Figure 4:
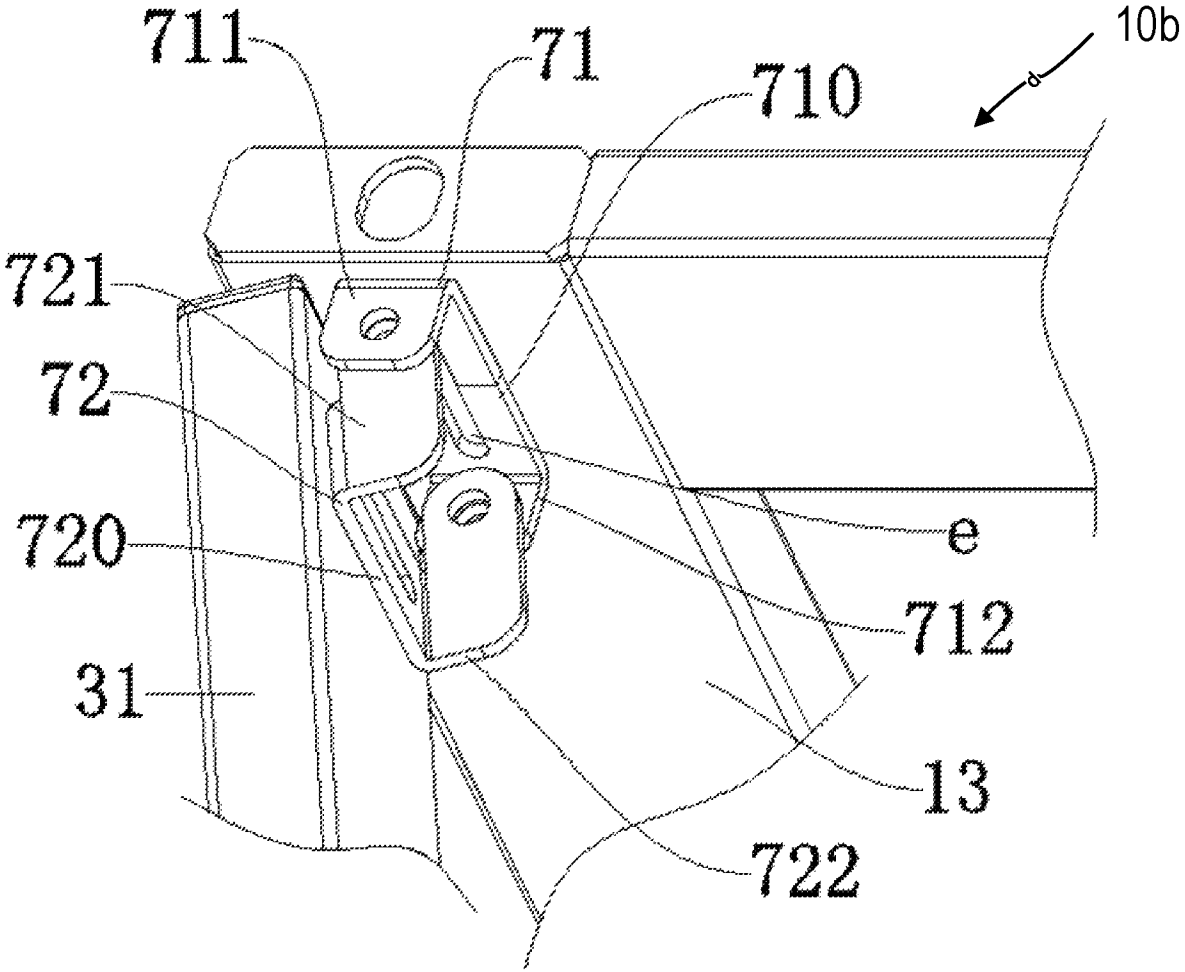
FIG. 4 is an enlarged view taken along circle B of FIG. 2.

Referring to FIG. 4, there is depicted an exemplary connector for connecting the distal end of second bar 312 of first bar unit 31 with first leg 13 of second supporting unit 10*b*. In some exemplary embodiments, second supporting unit 10*b* includes a first bracket such as first bracket 71 disposed at an interior side (e.g., the side facing the interior of the supporting frame) of second supporting unit 10*b*, for instance, at an interior side of first leg 13. First bracket 71 includes an upper portion such as upper portion 711, a middle portion such as middle portion 710 and a lower portion such as lower portion 712. Middle portion 710 is fixedly connected with first leg 13, for instance by welding through hole "e". In an exemplary embodiment, upper portion 711 and lower portion 712 are substantially perpendicular to middle portion 710.

In some exemplary embodiments, the distal end of second bar 312 of first bar unit 31 includes a second bracket such as second bracket 72 disposed at an interior side of second bar 312 of first bar unit 31. Second bracket 72 includes an upper portion such as upper portion 721, a middle portion such as middle portion 720 and a lower portion such as lower portion 722. Middle portion 720 is fixedly connected with second bar 312 of first bar unit 31, for instance by welding. In an exemplary embodiment, upper portion 721 and lower portion 722 are substantially perpendicular to middle portion 720.

The upper portion of the second bracket is rotatably connected with the upper portion of the first bracket, and the lower portion of the second bracket is rotatably connected with the lower portion of the first bracket. In some exemplary embodiments, the upper and lower portions of one of the first and second brackets are disposed between the upper and lower portions of the other of the first and second brackets. By way of example, FIG. 4 illustrates the upper and lower portions of the second bracket are disposed between the upper and lower portions of the first bracket.

It should be noted that each distal end of the first and second bars of the first and second bar units can be connected with its corresponding leg of the first or second supporting unit differently or in substantially the same way as illustrated in FIG. 4.

Figure 5:
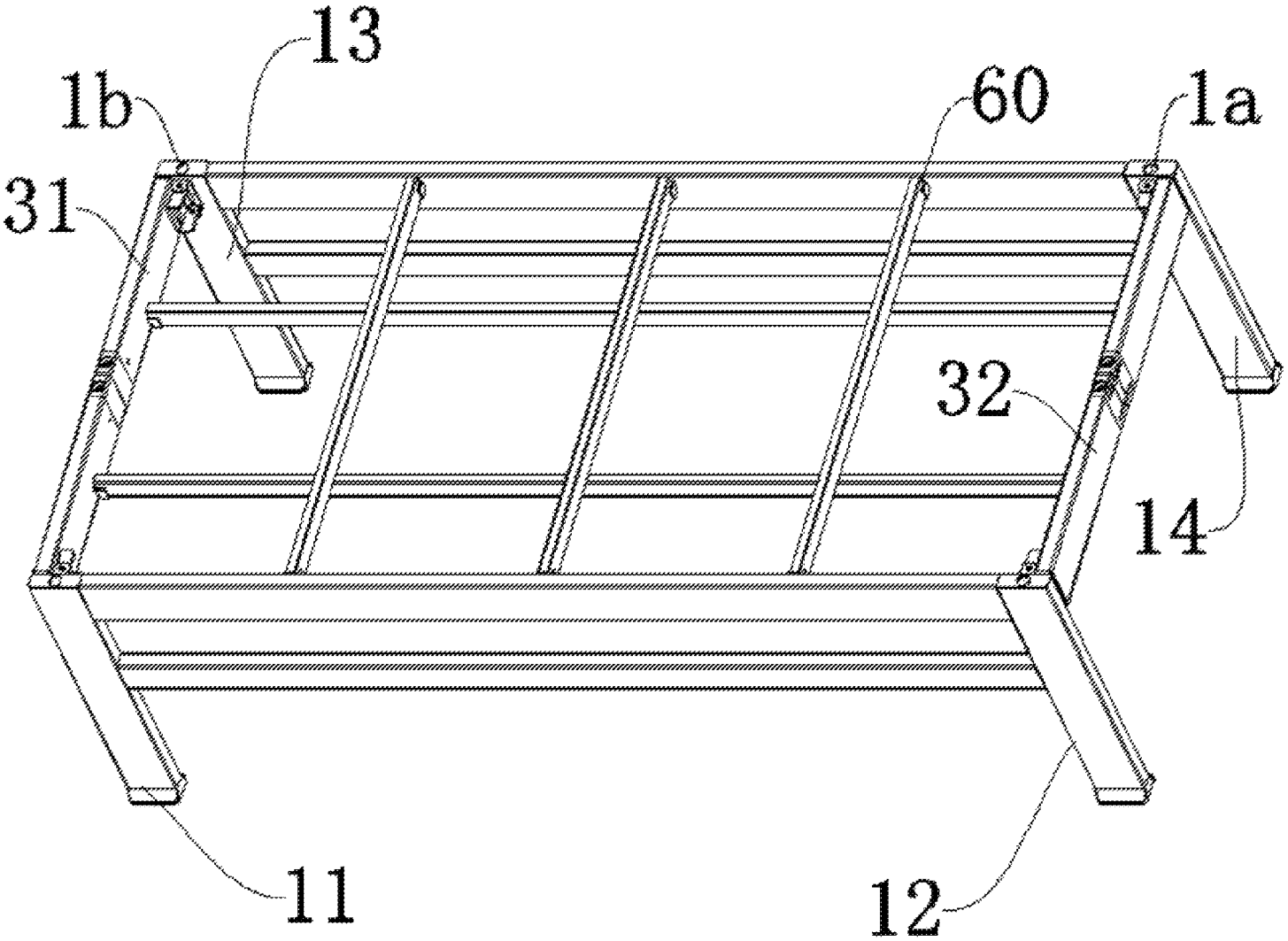
FIG. 5 is a perspective view illustrating an exemplary supporting frame in an expanded state in accordance with exemplary embodiments of the present invention.

In some exemplary embodiments, a plurality of receptacles is disposed at the first and second supporting units, or at the first and second bar units, or at both. Each receptacle is configured to removably receive an end of a supporting bar. For instance, by way of example, FIGS. 1, 2 and 5 illustrate a collapsible supporting frame including a plurality of first receptacles 60, a plurality of second receptacles 61 and a plurality of third receptacles 62.

The plurality of first receptacles 60 is spatially disposed along lateral connecting bar 21 and lateral connecting bar 22 at interior sides of the lateral connecting bars. Each first receptacle 60 is configured to removable receive an end of a longitudinal supporting bar. The plurality of second receptacles 61 is disposed at the first bar of first bar unit 31 and the first bar of second bar unit 32. The plurality of third receptacles 62 is disposed at the second bar of first bar unit 31 and the second bar of second bar unit 32. Each of the second and third receptacles is configured to removably receive an end of a lateral supporting bar.

It should be noted that the first, second and third receptacles can be configured the same as each other or differently from each other. In some exemplary embodiments, the first, second and third receptacles are disposed at different heights or elevations to offset the lateral and longitudinal supporting bars are offset from each other. For instance, by way of example, FIG. 5 illustrates first receptacles 60 are disposed at positions higher than the second and third receptacles such that the longitudinal supporting bars are disposed above the lateral supporting bars. The lateral and/or longitudinal supporting bars help to stabilize and strengthen the collapsible supporting frame and prevent the collapsible supporting frame from undesired contraction.

Figure 6:
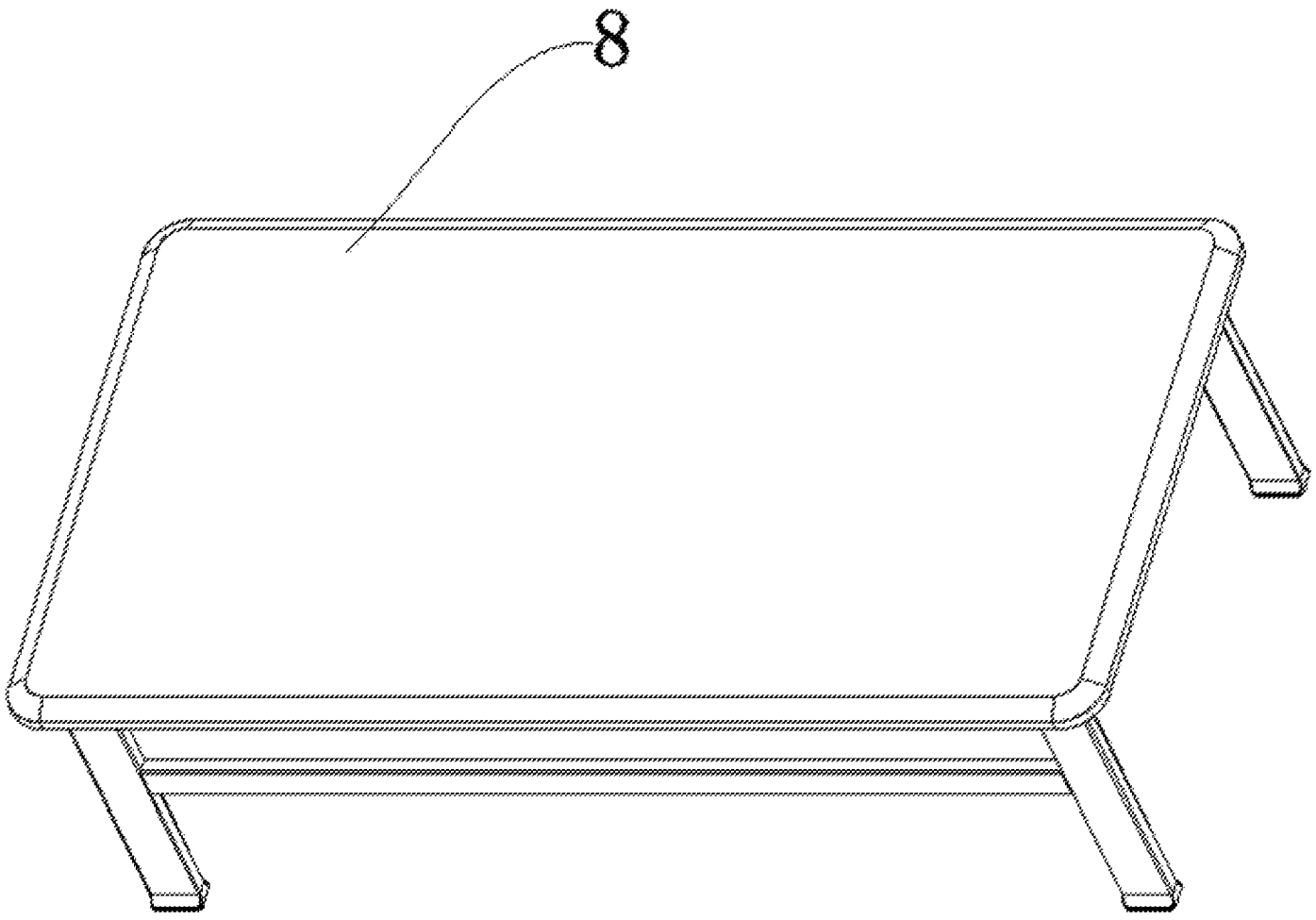
FIG. 6 is a perspective view illustrating an exemplary table including an exemplary supporting frame in accordance with exemplary embodiments of the present invention.

The collapsible supporting frame of the present invention can be used to make a variety of furniture. For instance, by way of example, FIGS. 5 and 6 illustrate the use of a collapsible supporting frame in a table (e.g., coffee table). The table includes a collapsible supporting frame of the present invention and a panel such as panel 8 coupled with and supported by the collapsible supporting frame. In such exemplary embodiments, first leg 11 and second leg 12 of first supporting unit 10*a*, and first leg 13 and second leg 14 of second supporting unit 10*b* have substantially the same length.

In some exemplary embodiments, at least one lateral pin hole (e.g., a hole for insertion of a pin along a substantially lateral direction) such as lateral pin hole 1*a* is formed on top of at least one leg in the first and second legs of the first and second supporting units, and at least one longitudinal pin hole (e.g., a hole for insertion of a pin along a substantially longitudinal direction) such as longitudinal pin hole 1*b* is formed on top of at least one leg in the first and second legs of the first and second supporting units. In an exemplary embodiment, a lateral pin hole and a longitudinal pin hole are formed at each of the first and second legs of the first and second supporting units.

To connect the panel with the supporting frame, panel 8 includes a plurality of pins disposed spatially along a periphery of the panel. When the panel is placed on the first and second supporting units, two or more pins in the plurality of pins are coupled with the lateral and longitudinal pin holes, thereby coupling the panel with the supporting frame. In some exemplary embodiments, the plurality of pins along the periphery of the panel is inserted into the lateral and longitudinal pin holes, thereby fixing the panel on the supporting frame and preventing the table from swaying.

Figure 7:
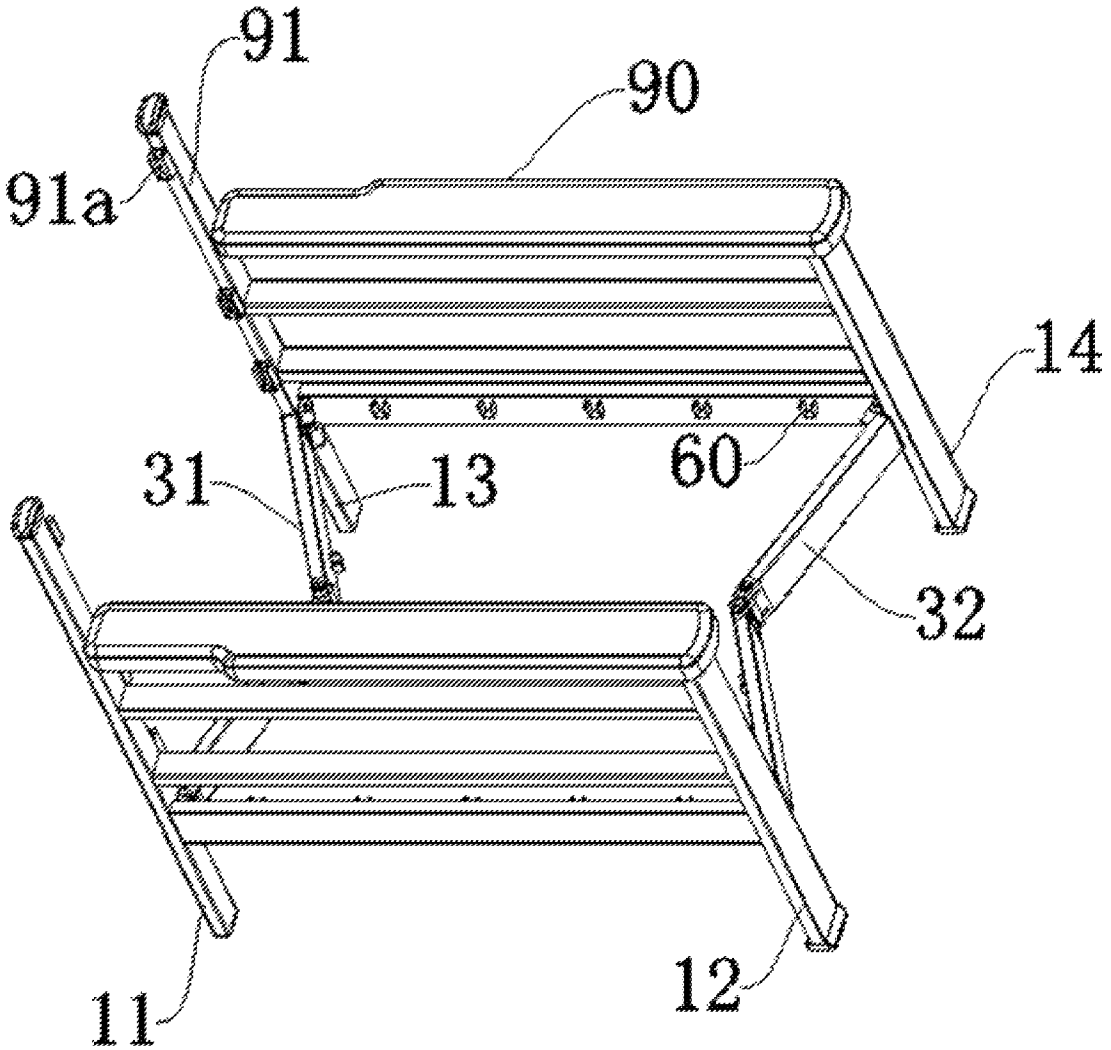
FIG. 7 is a perspective view illustrating an exemplary supporting frame in an intermediate state in accordance with exemplary embodiments of the present invention.
Figure 8:
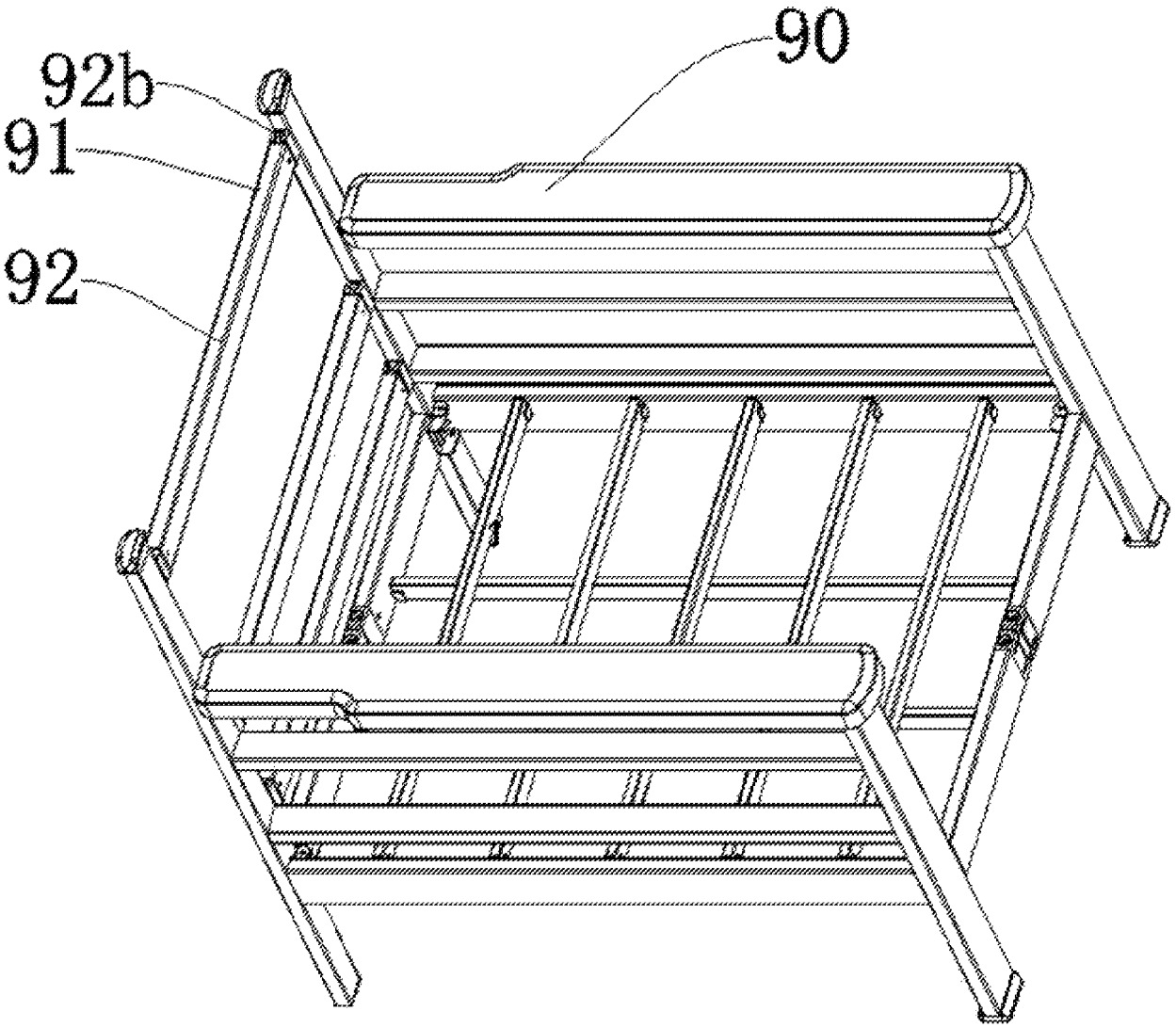
FIG. 8 is a perspective view illustrating an exemplary supporting frame in an expanded state in accordance with exemplary embodiments of the present invention.

As another example, FIGS. 7 and 8 illustrate the use of a collapsible supporting frame in a chair (e.g., armchair, lover seat). The chair includes a collapsible supporting frame of the present invention and a plurality of longitudinal connecting bars such as longitudinal connecting bar 92. In such exemplary embodiments, the first leg of each of the first and second supporting units includes a first upper portion above the first bar unit, e.g., each of first leg 11 and first leg 13 extending upwardly beyond first bar unit 31. The plurality of longitudinal connecting bars is disposed between the first upper portions of the first legs of the first and second supporting units and removably connected with the first upper portions of the first legs. When connected with the first upper portions of the first legs, the plurality of longitudinal connecting bars serves as a backrest such as backrest 91.

In some exemplary embodiments, to removably connect the longitudinal bars with the first upper portions of the first legs, a plurality of insertion slots such as slot 91*a* is disposed spatially along the first upper portions of the first legs of the first and second supporting units. In some exemplary embodiments, each end of a longitudinal connecting bar includes a corresponding coupler, such as coupler 92*b*, configured to couple with the slot. Coupler 92*b* is made with the longitudinal connecting bar or fitted (e.g., snap-fitted, glued, fastened, or the like) with the longitudinal connecting bar. In an exemplary embodiment, a slot is a "T" shaped slot open at a top and closed at a bottom. In another exemplary embodiment, each slot is a "T" shaped slot open at a top and closed at a bottom. Correspondingly, a coupler has a "T" shape matching with the "T" shape of the slot. Configuration (e.g., size, shape, position) of the slots, and accordingly the configuration of the couplers and the number of the longitudinal connecting bars are flexible and can be readily varied to meet various demands and personal preferences.

Through the slots and couplers, the longitudinal connecting bars are secured on the first upper portions of the first legs of the first and second supporting units. In addition to serving as a backrest, the longitudinal connecting bars help to stabilize and strengthen the collapsible supporting frame and prevent the collapsible supporting frame from swaying when unfolded or in use.

In some exemplary embodiments, the second leg of each of the first and second supporting units includes a second upper portion above the second bar unit, e.g., each of second leg 12 and second leg 14 extending upwardly beyond second bar unit 32. The second upper portion is shorter than the first upper portion. In some exemplary embodiments, each of the first and second supporting units further including an armrest such as armrest 90. In an exemplary embodiment, the armrest has a first end connected with the first upper portion of the first leg, and a second end disposed on top of the second upper portion of the second leg and connected with the second upper portion of the second leg.

In some exemplary embodiments, the lateral and longitudinal supporting bars are configured to support a seat.

As disclosed herein, the collapsible supporting frames of the present invention can contract and expand while the first supporting unit, the second supporting unit, the first bar unit and the second bar unit are connected with each other. As such, there is no need to assemble or disassemble these parts. Moreover, the sizes of the collapsible supporting frames when contracted are reduced significantly. As such, they require less space for shipping, transportation and storage. Further, the supporting frames of the present invention can be used to make a variety of furniture including but not limited to tables and chairs.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar unit could be termed a second bar unit, and, similarly, a second bar unit could be termed a first frame, without changing the meaning of the description, so long as all occurrences of the "first bar unit" are renamed consistently and all occurrences of the "second bar unit" are renamed consistently.

What is claimed is:

1. A collapsible supporting frame comprising:

a first supporting unit disposed at a first side of the collapsible supporting frame;

a second supporting unit disposed at a second side of the collapsible supporting frame;

a first bar unit having a first end rotatably connected with a first end of the first supporting unit and a second end rotatably connected with a first end of the second supporting unit; and a second bar unit having a first end rotatably connected with a second end of the first supporting unit and a second end rotatably connected with a second end of the second supporting unit;

wherein:

each of the first and second bar units comprises a first bar and a second bar;

each of the first and second bars comprises an upper slot and a lower slot at a proximal end thereof, wherein the upper slots of the first and second bars are symmetrically disposed with respect to each other, and the lower slots of the first and second bars are symmetrically disposed with respect to each other;

a first insert having a first end disposed in the upper slot of the first bar and rotatably connected with the first bar, and a second end disposed in the upper slot of the second bar and rotatably connected with the second bar; and a second insert having a first end disposed in the lower slot of the first bar and rotatably connected with the first bar, and a second end disposed in the lower slot of the second bar and rotatably connected with the second bar.

2. The collapsible supporting frame of claim 1, wherein:

each of the first and second bar units further comprises a first shaft substantially perpendicular to the first bar and a second shaft substantially perpendicular to the second bar;

the first or second insert comprises a first through-hole and a second through-hole; and the first or second insert is rotatably connected with the first bar by the first shaft through the first through-hole, and rotatably connected with the second bar by the second shaft through the second through-hole.

3. The collapsible supporting frame of claim 1, wherein middle portions of the first and second inserts are connected by a limiting member.

4. The collapsible supporting frame of claim 1, wherein the first bar comprises a first receptacle and the second bar comprises a second receptacle, wherein the first or second receptacle is configured to removably receive an end of a lateral supporting bar.

5. The collapsible supporting frame of claim 1, wherein:

each of the first and second supporting units comprises a first leg at the first end thereof and a second leg at the second end thereof;

the first bar unit is disposed between the first legs of the first and second supporting units;

the second bar unit is disposed between the second legs of the first and second supporting units;

each of the first and second legs of the first and second supporting units comprises a first bracket at an interior side thereof;

each of the first and second ends of the first and second bar units comprises a second bracket at an interior side thereof; and each first bracket is rotatably coupled with a corresponding second bracket.

6. The collapsible supporting frame of claim 5, wherein each of the first and second brackets comprises an upper portion, a middle portion and a lower portion, wherein the middle portion of the first bracket is fixedly connected with the first or second end of the first or second bar unit;

the middle portion of the second bracket is fixedly connected with the first or second leg of the first or second supporting unit;

the upper portion of the second bracket is disposed below and rotatably connected with the upper portion of the first bracket; and the lower portion of the second bracket is disposed above and rotatably connected with the lower portion of the first bracket.

7. The collapsible supporting frame of claim 6, wherein the middle portion of the first or second bracket is formed with a slot.

8. The collapsible supporting frame of claim 5, wherein:

a panel is disposed on the first and second supporting units, and connected with the first and second supporting units via at least one lateral pin hole formed on top of at least one leg in the first and second legs of the first and second supporting units and at least one longitudinal pin hole formed on top of at least one leg in the first and second legs of the first and second supporting units.

9. The collapsible supporting frame of claim 5, wherein the first leg of each of the first and second supporting units comprises a first upper portion above the first bar unit, the collapsible supporting frame further comprising:

a plurality of longitudinal connecting bars disposed between the first upper portions of the first legs of the first and second supporting units and removably connected with the first upper portions of the first legs by slots disposed at the first upper extensions and corresponding couplers at ends of the longitudinal connecting bars.

10. The collapsible supporting frame of claim 9, wherein each slot is a "T" shaped slot open at a top and closed at a bottom.

11. A structure comprising:

a first supporting unit and a second supporting unit disposed substantially symmetrically with each other, each comprising a first leg, a second leg, and one or more lateral connecting bars disposed between and fixedly connected with the first and second legs; and a first bar unit and a second bar unit disposed between the first and second supporting units, each comprising a first bar and a second bar, wherein the first and second bars are rotatably connected with each other at proximal ends thereof;

a distal end of the first bar is rotatably connected with the first or second leg of the first supporting unit;

a distal end of the second bar is rotatably connected with the first or second leg of the second supporting unit;

rotational movement of the first and second bars pulls the first and second supporting units together or pushes the first and second supporting units away from each other;

each of the first and second bars comprises an upper slot and a lower slot at the proximal end thereof, wherein the upper slots of the first and second bars are symmetrically disposed with respect to each other, and the lower slots of the first and second bars are symmetrically disposed with respect to each other;

a first insert having a first end disposed in the upper slot of the first bar and rotatably connected with the first bar, and a second end disposed in the upper slot of the second bar and rotatably connected with the second bar; and a second insert having a first end disposed in the lower slot of the first bar and rotatably connected with the first bar, and a second end disposed in the lower slot of the second bar and rotatably connected with the second bar.

12. The structure of claim 11, wherein middle portions of the first and second inserts are connected by a limiting member, wherein the limiting member restricts rotation of the first and second bars within certain positions.

13. The structure of claim 11, wherein the first bar comprises a first receptacle and the second bar comprises a second receptacle, wherein the first or second receptacle is configured to removably receive an end of a supporting bar.

14. A structure comprising:

a first supporting unit and a second supporting unit disposed substantially symmetrically with each other, each comprising a first leg, a second leg, and one or more lateral connecting bars disposed between and fixedly connected with the first and second legs; and a first bar unit and a second bar unit disposed between the first and second supporting units, each comprising a first bar and a second bar, wherein the first and second bars are rotatably connected with each other at proximal ends thereof;

a distal end of the first bar is rotatably connected with the first or second leg of the first supporting unit;

a distal end of the second bar is rotatably connected with the first or second leg of the second supporting unit;

rotational movement of the first and second bars pulls the first and second supporting units together or pushes the first and second supporting units away from each other;

each of the first and second legs of the first and second supporting units comprises a first bracket at an interior side thereof;

each distal end of the first and second bars of the first and second bar units comprises a second bracket at an interior side thereof;

each of the first and second brackets comprises an upper portion, a middle portion and a lower portion;

the middle portion of the first bracket is fixedly connected with the first or second leg of the first or second supporting unit;

the middle portion of the second bracket is fixedly connected with the first or second end of the first or second bar unit;

the upper portion of the second bracket is rotatably connected with the upper portion of the first bracket; and the lower portion of the second bracket is rotatably connected with the lower portion of the first bracket.

15. The structure of claim 14, wherein of each of the first and second brackets, the upper and lower portions are substantially perpendicular to the middle portion, wherein the upper and lower portions of one of the first and second brackets are disposed between the upper and lower portions of the other of the first and second brackets.

16. The structure of claim 11, further comprising a panel to form a table, wherein of each of the first and second supporting units, the first leg has a length substantially the same as the second leg;

at least one lateral pin hole is formed on top of at least one leg in the first and second legs of the first and second supporting units; and at least one longitudinal pin hole is formed on top of at least one leg in the first and second legs of the first and second supporting units; and the panel is disposed on the first and second supporting units, and connected with the first and second supporting units via the at least one lateral pin hole and the at least one longitudinal pin hole.

17. The structure of claim 11, further comprising a plurality of longitudinal connecting bars to form a chair, wherein the first leg of each of the first and second supporting units comprises a first upper portion above the first bar unit; and the plurality of longitudinal connecting bars is disposed between the first upper portions of the first legs of the first and second supporting units and removably connected with the first upper portions of the first legs, wherein the plurality of longitudinal connecting bars collectively serves as a backrest.

18. The structure of claim 17, wherein:

the second leg of each of the first and second supporting units comprises a second upper portion above the second bar unit, wherein the second upper portion is shorter than the first upper portion;

each of the first and second supporting units further comprises an armrest, wherein the armrest has a first end connected with the first upper portion of the first leg, and a second end disposed on top of the second upper portion of the second leg and connected with the second upper portion of the second leg.

19. The structure of claim 17, wherein:

the first bar comprises a first receptacle and the second bar comprises a second receptacle, wherein the first or second receptacle is configured to removably receive an end of lateral supporting bar;

of each of the first and second supporting units, a lateral connecting bar in the one or more lateral connecting bars comprises a plurality of third receptacles, each configured to removably receive an end of a longitudinal supporting bar that is disposed above or below the lateral supporting bars; and the lateral and longitudinal supporting bars are configured to support a seat.

20. A structure comprising:

a first supporting unit and a second supporting unit disposed substantially symmetrically with each other, each comprising a first leg, a second leg, and one or more lateral connecting bars disposed between and fixedly connected with the first and second legs;

a first bar unit and a second bar unit disposed between the first and second supporting units, each comprising a first bar and a second bar; and a plurality of longitudinal connecting bars, wherein the first and second bars are rotatably connected with each other at proximal ends thereof;

a distal end of the first bar is rotatably connected with the first or second leg of the first supporting unit;

a distal end of the second bar is rotatably connected with the first or second leg of the second supporting unit;

rotational movement of the first and second bars pulls the first and second supporting units together or pushes the first and second supporting units away from each other;

the first leg of each of the first and second supporting units comprises a first upper portion above the first bar unit;

the plurality of longitudinal connecting bars is disposed between the first upper portions of the first legs of the first and second supporting units and removably connected with the first upper portions of the first legs, wherein the structure is a chair and the plurality of longitudinal connecting bars collectively serves as a backrest of the chair.

21. The structure of claim 20, wherein each of the first and second legs of the first and second supporting units comprises a first bracket at an interior side thereof;

each distal end of the first and second bars of the first and second bar units comprises a second bracket at an interior side thereof;

each of the first and second brackets comprises an upper portion, a middle portion and a lower portion;

the middle portion of the first bracket is fixedly connected with the first or second leg of the first or second supporting unit;

the middle portion of the second bracket is fixedly connected with the first or second end of the first or second bar unit;

the upper portion of the second bracket is rotatably connected with the upper portion of the first bracket; and the lower portion of the second bracket is rotatably connected with the lower portion of the first bracket.

* * * * *